US011192379B2

(12) United States Patent
Narazaki et al.

(10) Patent No.: US 11,192,379 B2
(45) Date of Patent: Dec. 7, 2021

(54) PRINTING APPARATUS, CONTROL METHOD OF THE SAME, AND TRANSPORTATION METHOD OF THE SAME

(71) Applicant: CANON KABUSHIKI KAISHA, Tokyo (JP)

(72) Inventors: Tetsuya Narazaki, Inagi (JP); Hirokazu Yoshikawa, Yokohama (JP); Kei Kosaka, Tokyo (JP); Koki Shimada, Kawasaki (JP); Yusuke Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 16/826,628

(22) Filed: Mar. 23, 2020

(65) Prior Publication Data

US 2020/0316951 A1 Oct. 8, 2020

(30) Foreign Application Priority Data

Apr. 5, 2019 (JP) ..... JP2019-073080

(51) Int. Cl.
*B41J 2/175* (2006.01)
*B41J 2/165* (2006.01)

(52) U.S. Cl.
CPC ..... *B41J 2/175* (2013.01); *B41J 2/16505* (2013.01); *B41J 2/17596* (2013.01)

(58) Field of Classification Search
CPC ..... B41J 2/175; B41J 2/17596; B41J 2/16505
See application file for complete search history.

(56) References Cited

U.S. PATENT DOCUMENTS

| | | | | |
|---|---|---|---|---|
| 7,014,292 | B2 | 3/2006 | Yazawa et al. | |
| 7,207,649 | B2 | 4/2007 | Ide et al. | |
| 7,445,309 | B2 | 11/2008 | Ide et al. | |
| 7,794,044 | B2 | 9/2010 | Yoshikawa et al. | |
| 8,201,919 | B2 | 6/2012 | Mizoguchi et al. | |
| 8,517,503 | B2 | 8/2013 | Mizoguchi et al. | |
| 9,108,410 | B2 | 8/2015 | Hamasaki et al. | |
| 9,446,595 | B2 | 9/2016 | Takarabe et al. | |
| 9,517,628 | B2 | 12/2016 | Tenkawa et al. | |
| 10,207,506 | B2 | 2/2019 | Iwasaki et al. | |
| 2005/0195241 | A1* | 9/2005 | Kawai | B41J 2/1721 347/36 |
| 2006/0164448 | A1* | 7/2006 | Sugiyama | B41J 29/393 347/5 |
| 2011/0148965 | A1 | 6/2011 | Taira et al. | |

FOREIGN PATENT DOCUMENTS

JP 2014-188929 A 10/2014

OTHER PUBLICATIONS

U.S. Appl. No. 16/832,431, filed Mar. 27, 2020 (first named inventor: Satoko Yaita).

* cited by examiner

*Primary Examiner* — Justin Seo
(74) *Attorney, Agent, or Firm* — Venable LLP

(57) ABSTRACT

There is provided a printing apparatus. A cap caps an ink ejection surface of a printhead. An ink suction path is connected to the cap and sucks the ink in the cap. An ink tank stores the ink to be supplied to the printhead. An ink supply path connects the printhead to the ink tank. A first closing unit closes the ink suction path. A second closing unit closes the ink supply path. A control unit is able to execute a first control mode in which the first closing unit closes the ink suction path and a second control mode in which the second closing unit closes the ink supply path.

19 Claims, 12 Drawing Sheets

PRINTING APPARATUS, CONTROL METHOD OF THE SAME, AND TRANSPORTATION METHOD OF THE SAME

BACKGROUND OF THE INVENTION

Field of the Invention

The present invention relates to a printing apparatus, a control method of the same, and a transportation method of the same.

Description of the Related Art

Conventionally, there is known a printing apparatus in which a printhead that ejects ink and an ink tank that stores ink to be supplied to the printhead are connected by a tube. Japanese Patent Laid-Open No. 2014-188929 discloses a printing apparatus that includes a valve between a printhead and an ink tank to suppress ink leakage when such a printing apparatus is to be transported.

SUMMARY OF THE INVENTION

According to one embodiment of the present invention, a printing apparatus that includes a cap configured to cap an ink ejection surface of a printhead configured to eject ink, an ink suction path connected to the cap and configured to suck the ink in the cap, an ink tank configured to store the ink to be supplied to the printhead, and an ink supply path configured to connect the printhead to the ink tank, comprising: a first closing unit configured to close the ink suction path; a second closing unit configured to close the ink supply path; and a control unit configured to be able to execute a first control mode in which the first closing unit closes the ink suction path and a second control mode in which the second closing unit closes the ink supply path.

According to another embodiment of the present invention, a control method of a printing apparatus that includes, a cap configured to cap an ink ejection surface of a printhead configured to eject ink, an ink suction path connected to the cap and configured to suck ink in the cap, an ink tank configured to store the ink to be supplied to the printhead, and an ink supply path configured to connect the printhead to the ink tank, the method comprising: performing a first closing process in which the ink suction path is closed; performing a second closing process in which the ink supply path is closed; and performing a control process in which a first control mode in which the ink suction path is closed by the first closing process and a second control mode in which the ink supply path is closed by the second closing process can be executed.

According to still another embodiment of the present invention, a transportation method of a printing apparatus that includes, a cap configured to cap an ink ejection surface of a printhead configured to eject ink, an ink suction path connected to the cap and configured to suck ink in the cap, an ink tank configured to store the ink to be supplied to the printhead, and an ink supply path configured to connect the printhead to the ink tank, the method comprising: performing a first closing process in which the ink suction path is closed; performing a second closing process in which the ink supply path is closed; performing a control process in which a first control mode in which the first closing process is performed to close the ink suction path and a second control mode in which the second closing process is performed to close the ink supply path can be executed; performing a first transportation process of transporting the printing apparatus upon closing the ink suction path by the first control mode; and performing a second transportation process of transporting the printing apparatus upon closing the ink supply path by the second control mode.

Further features of the present invention will become apparent from the following description of exemplary embodiments (with reference to the attached drawings).

DESCRIPTION OF THE EMBODIMENTS

Figure 1:
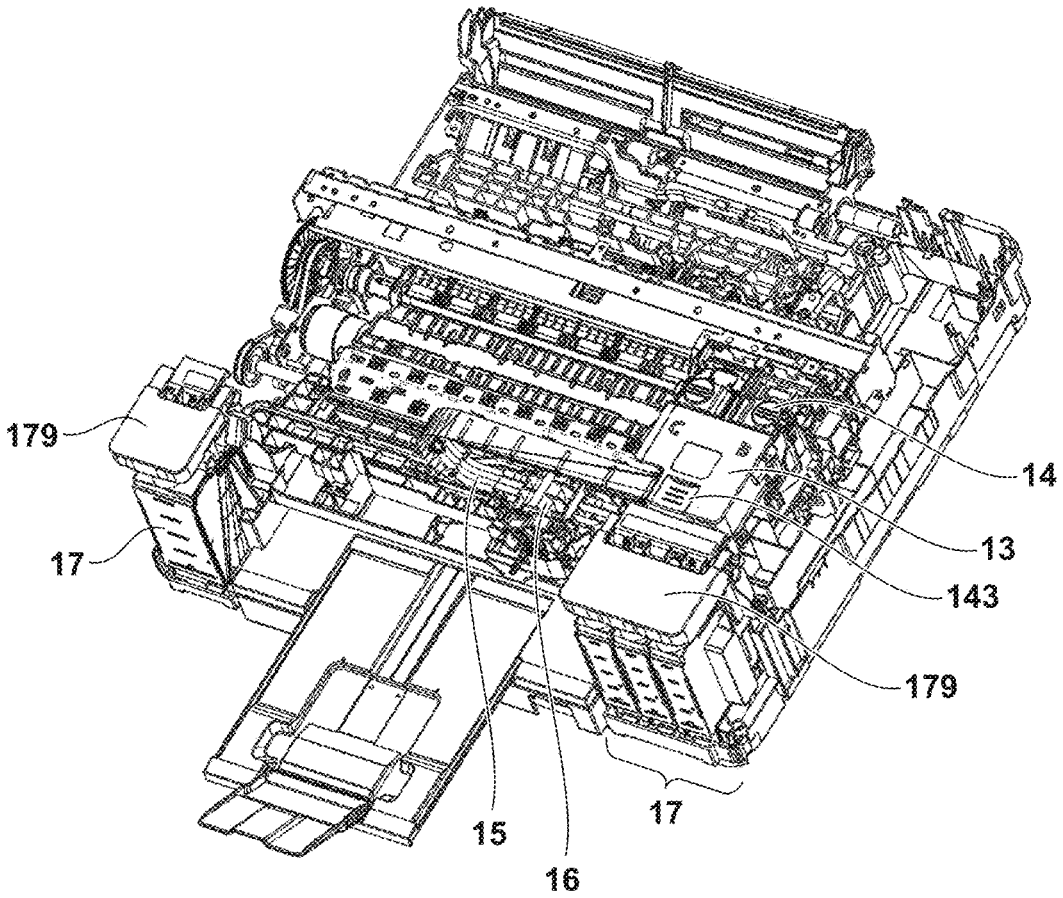
FIG. 1 is a schematic view showing the internal structure of a printing apparatus according to an embodiment.

However, according to the conventional technique described above, even if the valve provided on the tube connecting the ink tank and the printhead is closed at the time of transportation, the ink may leak because the air inside the tube and the printhead may expand due to a change in the pressure or temperature.

In consideration of the above problem, an embodiment provides a technique to suppress ink leakage more effectively.

Embodiments will be described in detail hereinafter with reference to the accompanying drawings. Note that the following embodiments do not limit the invention of the appended claims. Although a plurality of characteristic features are described in the embodiments, not all of the characteristic features are essential to the present invention, and the plurality of characteristic features may be arbitrarily combined. Furthermore, same reference numerals are used to denote same arrangements or arrangements similar to each other in the accompanying drawings, and a repetitive description thereof will be omitted.

In this specification, the term "printing" not only includes the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

In addition, the term "print medium" not only includes a paper sheet used in common printing apparatuses, but also broadly includes conveyable media, such as cloth, a plastic film, a metal plate, glass, ceramics, wood, leather, and the like.

Furthermore, the term "ink" (to also be referred to as a "liquid" hereinafter) should be extensively interpreted in a similar manner to the definition of "printing (print)" described above, and includes a liquid which, when applied onto a print medium, can form images, figures, patterns, and the like, can process the print medium, or can process ink (for example, solidify or insolubilize a coloring material contained in ink applied to the print medium).

First Embodiment

<Schematic Arrangement of Printing Apparatus>

Figure 14A:
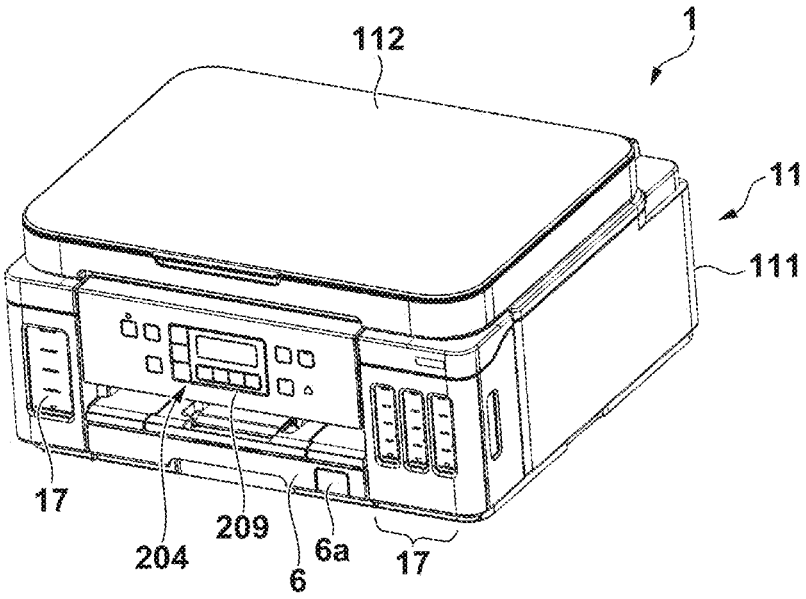
FIG. 14A is a perspective view schematically showing the printing apparatus according to an embodiment.
Figure 14B:
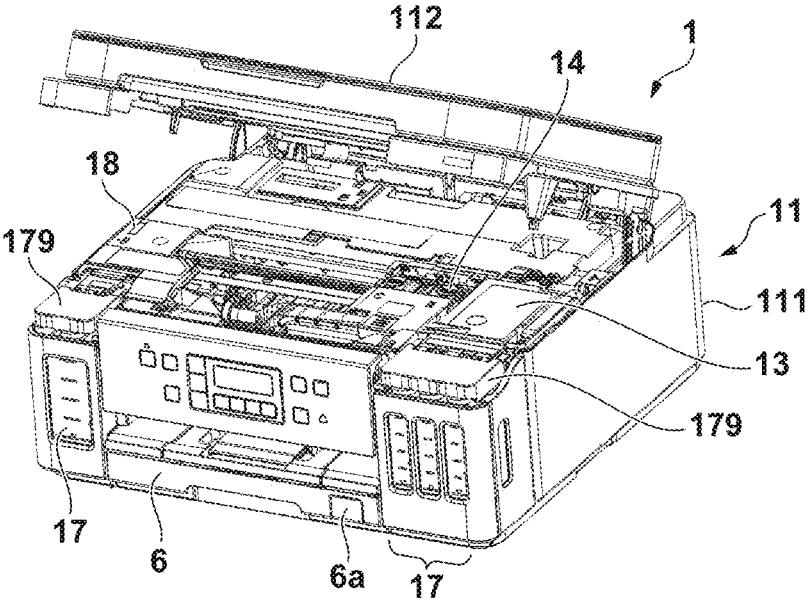
FIG. 14B is a perspective view schematically showing the printing apparatus in which a cover member is in an opening state.

FIG. 14A is a perspective view schematically showing an inkjet printing apparatus 1 (to be referred to as the printing apparatus 1 hereinafter) according to an embodiment. FIG. 14B is a perspective view of the printing apparatus 1 in which a cover member 112 is in an opening state. The printing apparatus 1 includes a housing 11, a printhead 14 that performs a printing operation on a print medium, and ink tanks 17 that serve as ink storage units for storing inks supplied to the printhead 14. In this embodiment, each ink tank 17 is arranged on the front surface of the housing 11 and is fixed to the apparatus body. In the same manner, a display unit 209 that can display information set to the printing apparatus 1 by a user, an error message, and the like is included on the front surface of the housing 11. The display unit 209 is, for example, a liquid crystal panel. In this embodiment, the display unit 209 includes a touch panel which serves as an input unit 204 to which inputs such as instruction inputs and the like can be input. The input unit 204 may be arranged as a hard key or the like which is arranged separately from the display unit 209.

A sheet feeding cassette 6 that can be inserted to/removed from the housing 11 by the user is provided on the front surface of the housing 11. A window portion 6*a* is arranged in the sheet feeding cassette 6 so that a user can visually confirm the print media stacked inside. The window portion 6*a* can be formed by a transparent member such as glass, plastic, or the like.

In this embodiment, the housing 11 includes a main body 111 and the cover member 112 that can open/close the main body 111. In this embodiment, the cover member 112 has been provided with a scanner unit that reads an original. Opening the cover member 112 exposes ink tank covers 179 capable of covering the upper surfaces of the corresponding ink tanks 17. In FIG. 14B, the ink tank covers 179 are in a closed state. Note that it may be arranged so the cover member 112 can open/close the main body 111 of the housing 11 without incorporating the scanner unit, and the arrangement of the scanner unit is omitted in the description hereinafter.

FIG. 1 is a schematic view showing the internal structure of the printing apparatus 1, and is a view showing a state in which the housing 11 has been removed. The printing apparatus 1 includes supply tubes 15, each of which forms an ink supply path 155 (See FIG. 3) from the corresponding ink tank 17 to the printhead 14. The printing apparatus 1 also includes a carriage 13 that moves reciprocally while carrying printhead 14.

The printing apparatus 1 includes a plurality of rollers (conveying units) that convey a sheet-like print medium, and these rollers convey the print medium in a conveyance direction perpendicular to a movement direction (main scanning direction) of the carriage 13 (the printhead 14). A rotatably supported detachment/attachment operation 143 is arranged in the carriage 13. A user can operate the detachment/attachment operation 143 to detach or attach the printhead 14 from or to the carriage 13.

In this embodiment, the printing apparatus 1 includes a manual valve 16 for closing/communicating the ink supply paths 155 formed by the supply tubes 15. That is, the manual valve 16 is arranged on the ink supply paths 155 and is capable of switching between an opening state which allows the ink tanks 17 and the printhead 14 to communicate and a closing state which does not allow the ink tanks and the printhead to communicate. The manual valve 16 includes an operating portion 161 (see FIGS. 4A and 4B) for the user to operate the manual valve 16. The user can manually operate the operating portion 161 to open/close the manual valve 16. That is, the operating portion 161 can be operated to switch the manual valve 16. In this embodiment, the operating portion 161 is arranged at the back of the display unit 209 in FIG. 14B, and the user can operate the operating portion 161 by opening the cover member 112. That is, the operating portion 161 is arranged at a position which will be exposed when the cover member 112 is opened. However, the operating portion 161 may be arranged at a position which will be exposed regardless of the opening/closing of the cover member 112.

Figure 2:
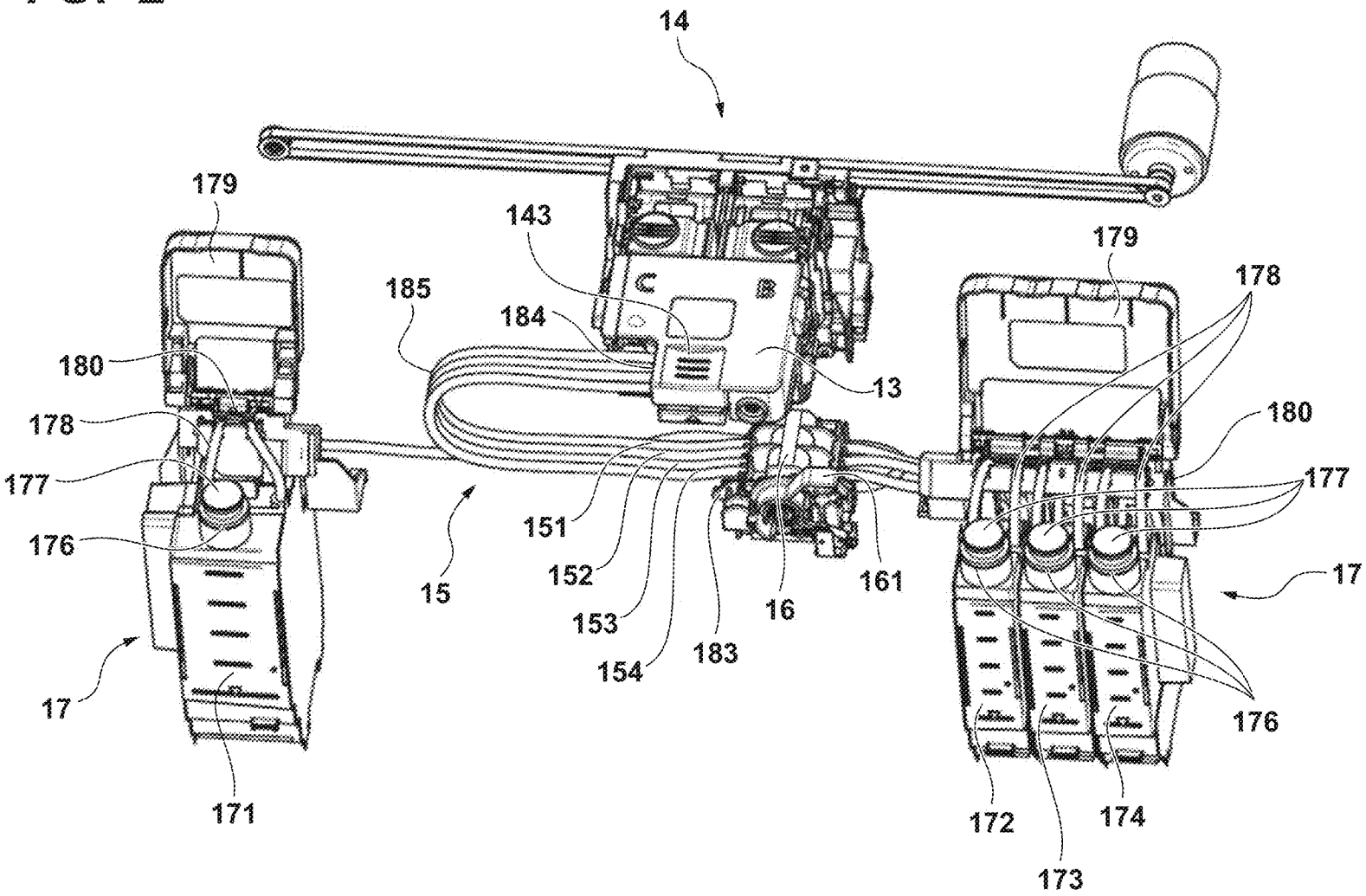
FIG. 2 is a schematic view of ink tanks, a printhead, and supply tubes that connect the ink tanks to the printhead.

The arrangement of the ink tanks 17 and the supply tubes 15 will be described next with reference to FIG. 2. FIG. 2 is a schematic view of the ink tanks 17 (ink storage units), the printhead 14, and the supply tubes 15 which connect these components. The printing apparatus 1 includes the plurality of ink tanks 17 in correspondence with the ink colors. In this embodiment, the printing apparatus is provided with four ink tanks 17, that is, a black ink tank 171, a cyan ink tank 172, a magenta ink tank 173, and a yellow ink tank 174. In this embodiment, the black ink tank 171 is arranged on one side of the widthwise direction of the printing apparatus 1, and the cyan ink tank 172, the magenta ink tank 173, and the yellow ink tank 174 are arranged side by side on the other side. That is, as shown in FIG. 1, it is arranged so that a print medium 19 that has been printed will pass between the black ink tank 171 and the color ink tanks.

Note that the ink tank 17 is a generic name for the ink tank of each ink color. Assume that the arrangement of the ink tank 17 to be described below is included in the ink tank of each ink color. It is likewise for the arrangement of the supply tube 15 and each of supply tubes 151 to 154 of the respective ink colors.

The supply tube 15 for supplying ink to the printhead 14 is attached to each ink tank 17. In this embodiment, each supply tube 15 is a supply path formation member that forms the ink supply path 155 for supplying ink from the corresponding ink tank 17 to the printhead 14. In this embodiment, the tube that forms the supply tube 15 is made of a flexible material such as an elastomer or the like, and the tube can bend or be squashed in accordance with the movement of the printhead 14 to block the ink supply path 155 inside the supply tube.

An atmosphere communication tube 178 that communicates the inside of the ink tank to the atmosphere is attached to each ink tank 17. The ink injection port 176 (injection portion) for injecting ink is arranged on the upper portion of each ink tank 17. The ink tank cap 177 for sealing the ink injection port 176 is arranged on each ink injection port 176. The user can remove the ink tank cap 177 to inject ink from the ink injection port 176 to each ink tank 17.

An ink tank valve 180 that blocks the communication of ink or air is arranged in each of the supply tubes 15 and the atmosphere communication tubes 178. In this embodiment, the ink tank valves 180 are arranged on both the side of the black ink tank and the side of the color ink tanks.

When the ink tank valves 180 on the side of the black ink tank are closed, the communication of the ink supply path 155 of the supply tube 15 connected to the black ink tank 171 and the communication of the channel inside the atmosphere communication tube 178 are closed. When the ink tank valves 180 on the side of the color ink tanks are closed, the ink supply paths 155 of the supply tubes 15 and the channels of the atmosphere communication tubes 178 connected to the cyan ink tank 172, the magenta ink tank 173, and the yellow ink tank 174 are closed.

The manual valve 16 is arranged between the printhead 14 and ink tank valves 180 of the supply tubes 15 and switches between a communication state and a non-communication state of ink or air inside the supply tube. When the manual valve 16 is closed, the communication of the black ink supply tube 151, the cyan ink supply tube 152, the magenta ink supply tube 153, and the yellow ink supply tube 154 of the ink supply paths 155 are integrally blocked.

Figure 3:
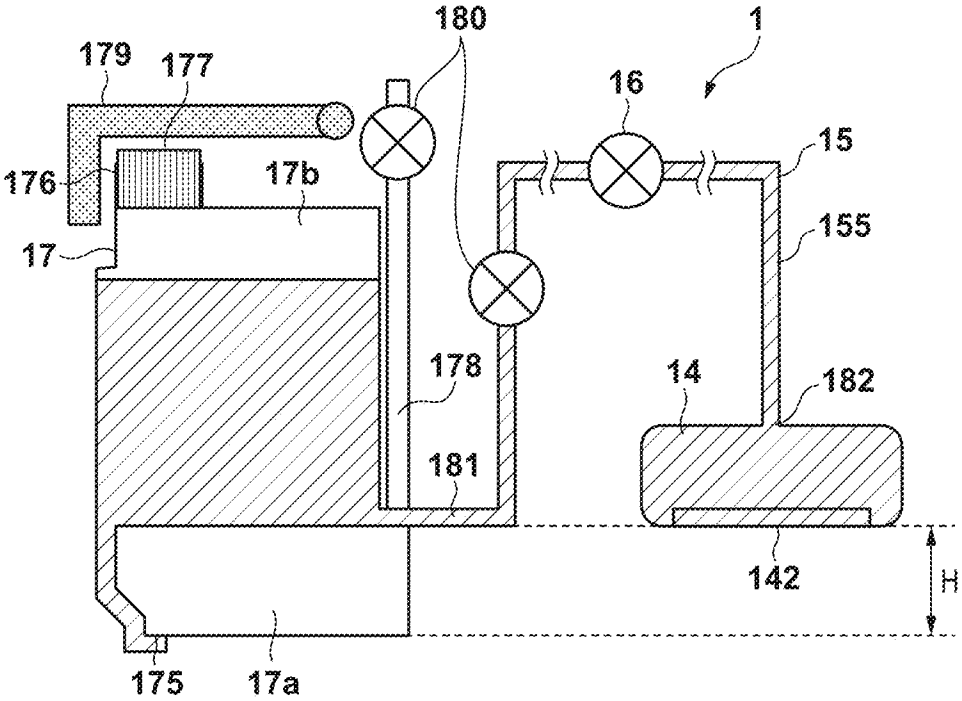
FIG. 3 is a schematic view showing the positional relationship of the ink tank and the printhead according to an embodiment.

FIG. 3 is a schematic view showing the positional relationship between the ink tank 17 and the printhead 14. In the printing apparatus 1, to prevent the leakage of ink from an ink ejection port 142 of the printhead 14, a gas/liquid exchange unit 175 of the ink tank 17 has been arranged at a position lower by a height H than the ink ejection port 142 of the printhead 14 in the height direction. That is, it is arranged so that a pressure due to a head difference corresponding to the height H is put on the ink ejection port 142. Note that the gas/liquid exchange unit 175 is formed having an opening area which can maintain the meniscus of the ink. A buffer chamber 17*a* is arranged at the lower portion of the ink tank 17. The buffer chamber 17*a* can store ink that has been pressed out and has broken the meniscus of the gas/liquid exchange unit 175 when the air in an ink storage chamber 17*b* that stores the ink expands due to a pressure change or a temperature change. This prevents the ink from flowing through the atmosphere communication tube 178 and leaking from the ink tank 17.

Also, a joint portion 182 is a member connecting the channel between the supply tube 15 and the printhead 14, and is arranged in the detachment/attachment operation 143. When the user operates the detachment/attachment operation 143 in an opening direction to remove the printhead 14 from the carriage 13, the joint portion 182 is removed from the printhead 14. As a result, the connection between the supply tube 15 and the printhead 14 is blocked. Also, when the user is to attach the printhead 14 to the carriage 13, a pressing portion (not shown) can be pressed by closing the detachment/attachment operation 143 to implement the joint connection of the joint portion 182. The joint connection of the joint portion 182 allows the channel between the supply tube 15 and the printhead 14 to communicate, and allows ink to be supplied to the printhead 14.

The arrangement of the ink supply system and the sequence until a printing operation can be performed according to this embodiment will be described next with reference to FIGS. 14A, 14B, 2, and 3.

When ink is to be injected, the user will open the ink tank cover 179, remove the ink tank cap 177, and inject ink, from an ink bottle or the like, to the ink tank 17 from the ink injection port 176. At this time, the ink tank valves 180 will close interlockingly with the closing of the ink tank cover 179, thus closing the channel of the supply tube 155 and the channel of the atmosphere communication tube 178. Also, when the injection of ink is completed, the user will use the ink tank cap 177 to seal the ink injection port 176, and close the ink tank cover 179. At this time, interlockingly with the closing of the ink tank cover 179, the ink tank valves 180 will switch from the closing state to the opening state, and the channel of supply tube 155 and the channel of the atmosphere communication tube 178 communicate as a result. That is, the channel of the supply tube 155 and the channel of the atmosphere communication tube 178 are closed by the corresponding ink tank valves 180 while the ink tank cap 177 is removed and the ink injection port 176 is open to the atmosphere.

After detecting the completion of ink injection, the printing apparatus 1 can perform an ink suction operation from the ink ejection ports 142 by pressing suction caps 211 (see FIG. 6) on the ejection port surface of the printhead 14. The supply tubes 15 and the printhead 14 are filled with ink by this suction operation. Note that the detection of the completion of ink injection is performed by a cover sensor 18 detecting that the cover member 112 has been closed. However, the present invention is not limited to this. The completion of ink injection may be detected by causing a remaining amount detection unit that detects the amount of remaining ink in the ink tank 17 to detect that ink of an amount equal to or more than a predetermined amount has been injected. Subsequently, when ink is ejected from the ink ejection ports 142 of the ink-filled printhead 14 in accordance with the printing operation, the pressure inside the printhead 14 increases in correspondence with the amount of reduction of the ink, and ink is supplied from the ink tank 17 to the printhead 14. As a result, ink is continuously supplied from the ink tank 17 to the printhead 14 until the ink in the ink tank 17 is less than a predetermined amount.

Figure 4A:
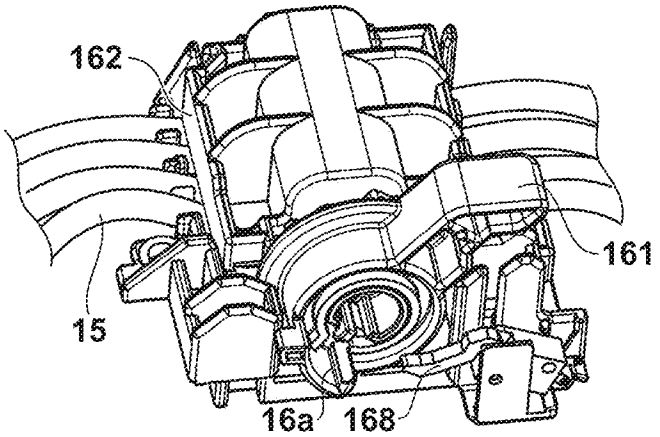
FIGS. 4A and 4B are perspective views schematically showing a manual valve according to an embodiment.
Figure 4B:
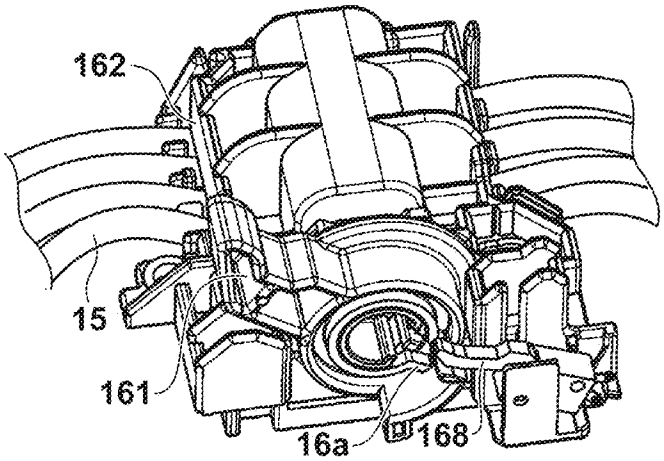
Figure 5A:
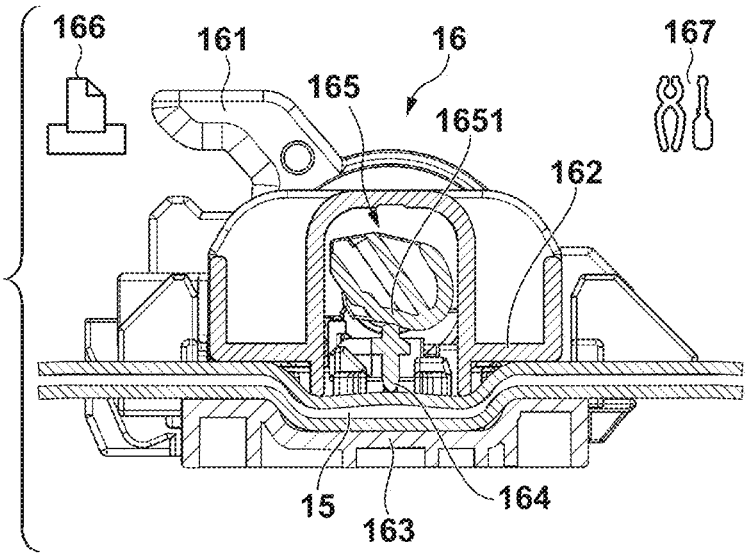
FIGS. 5A and 5B are sectional views schematically showing the manual valve according to an embodiment.
Figure 5B:
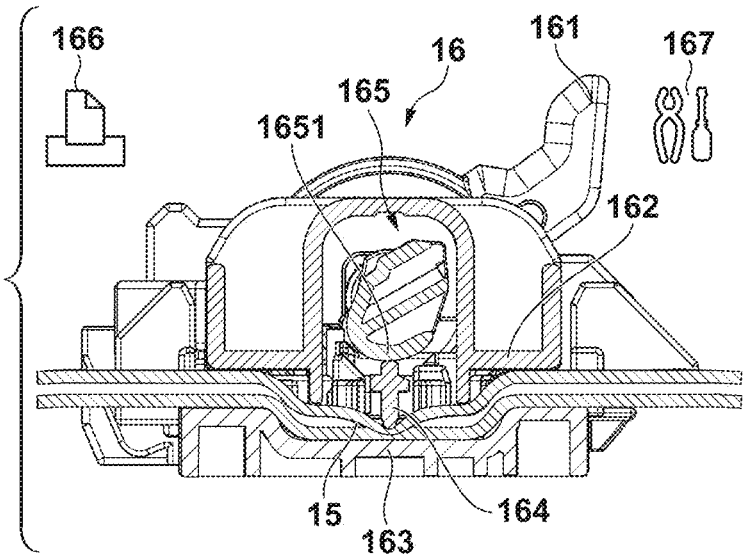

The arrangement of the manual valve 16 according to this embodiment will be described next. FIGS. 4A and 4B are perspective views schematically showing the manual valve 16 according to this embodiment. In addition, FIGS. 5A and 5B are sectional views schematically showing the manual valve 16 according to this embodiment. The positions of a print mark 166 and a maintenance mark 167 shown in FIGS. 5A and 5B are virtual positions. In the printing apparatus 1, the print mark 166 and the maintenance mark 167 are arranged at the positions indicated in FIG. 1B.

The manual valve 16 includes the operating portion 161 which can be operated by the user, and a holding portion 162, a receiving member 163, a displacement member 164, and a cam 165.

The holding portion 162 holds the supply tubes 15. One end of each supply tube 15 is connected to the printhead 14 and the other end is connected to the ink tank 17. The supply tube 15 includes a bending region that can bend in accordance with the movement of the printhead 14. The manual valve 16 is arranged on the supply tube 15 so that the bending region will be between the printhead 14 and the holding portion 162. That is, the manual valve 16 is arranged in a region, of each supply tube 15, that will not move in accordance with the movement of the carriage 13. Also, although the supply tube 15 is fixed by a first fixing portion 184 on the side of the printhead 14 and a second fixing portion 183 on the side of the corresponding ink tank 17, the holding portion 162 serves as the second fixing portion 183. As a result, the number of components can be reduced.

The displacement member 164 is a member that can be displaced in a direction that interferes with the supply tube 15. In other words, the displacement member 164 is arranged so as to be able to reciprocally move to and from the supply tube 15. Also, the receiving member 163 is a member to receive the displacement member 164 that is displaced in the direction that interferes with the supply tube 15. The receiving member 163 is arranged on the opposite side of the side on which the displacement member 164 is arranged with respect to the supply tube 15. The ink supply path 155 is closed when the displacement member 164 squashes the supply tube 15 by pressing the supply tube 15 against the receiving member 163.

The cam 165 displaces the displacement member 164. In this embodiment, the cam 165 is formed integrally with the operating portion 161. The cam 165 abuts against the displacement member 164 via a cam surface 1651. When the user operates the operating portion 161, the cam 165 rotates in accordance with the operation, and the displacement member 164 pressed by the cam surface 1651 is displaced. As a result, the user can make the ink supply path 155 close or communicate by the operating portion 161.

An operation in which the manual valve 16 closes the supply tube 15 according to this embodiment will be described next. FIG. 4A shows a state (opening state) in which the displacement member 164 is not squashing the supply tube 15 and the ink supply path 155 communicates. At this time, the operating portion 161 is positioned on the side indicated by the print mark 166. In this state, ink inside the supply tube 15 can be supplied from the ink tank 17 to the printhead 14 via the ink supply path 155. When the user rotatably operates the operating portion 161 from this state to the side indicated by the maintenance mark 167, the cam surface 1651 of the cam 165 integrally arranged with the manual valve 16 will also rotate, and the cam surface 1651 will displace the displacement member 164 in the direction that interferes with the supply tube 15.

FIG. 4B shows a state (closing state) in which the displacement member 164 is squashing the supply tube 15 and the ink supply path 155 is closed. As shown in FIG. 5B, the supply tube 15 is squashed between the displacement member 164 and the receiving member 163, thus closing the ink supply path 155. At this time, the supply tube 15 is in a state in which the ink from the ink tank 17 cannot be supplied to the printhead 14. Also, if the ink is absent, the supply tube 15 will be in a state which is not in communication with the atmosphere.

Note that in this embodiment, the supply tubes 15 of the ink supply paths 155 of all of the ink colors are simultaneously closed by the closing of the manual valve 16. However, a plurality of manual valves 16 may be provided so that each ink supply path 155 can be individually closed by arranging a manual valve for the supply tube 15 of each ink color. Alternatively, the manual valve 16 may be arranged on each of the black ink side and the color ink side.

Referring to FIG. 14A and FIG. 14B again, the operating portion 161 is arranged at a position covered by the housing 11 and the cover member 112 as shown in FIG. 14A. That is, the operating portion 161 is arranged so as to be exposed when the cover member 112 is opened. The printing apparatus 1 is controlled not to perform the printing operation by the printhead 14 while the cover sensor 18 detects the opening state of the cover member 112. Arranging the operating portion 161 in the inner side of the cover member 112 can suppress the user from erroneously operating the operating portion 161 while the printing apparatus 1 is performing a printing operation or the like.

Also, since the cover sensor 18 is arranged in this embodiment, the printing apparatus 1 can use the cover sensor 18 to detect whether it is in a state in which the user can operate the operating portion 161. The cover sensor 18 is not limited to a mechanical sensor that detects a mechanical contact, but also may be, for example, an optical sensor.

In addition, as shown in FIGS. 4A and 4B, a manual valve sensor 168 that detects the opening/closing state of the manual valve 16 is arranged in the manual valve 16. In this embodiment, the manual valve sensor 168 is a switch which operates mechanically. When the user operates the operating portion 161, an operating member 16*a* provided on the operating portion 161 moves a movable portion of the manual valve sensor 168 and causes the manual valve sensor 168 to operate. As a result, the closing state and the opening state of the manual valve 16 can be detected. Note that an optical sensor or another known arrangement can be adopted as the manual valve sensor 168.

Figure 6:
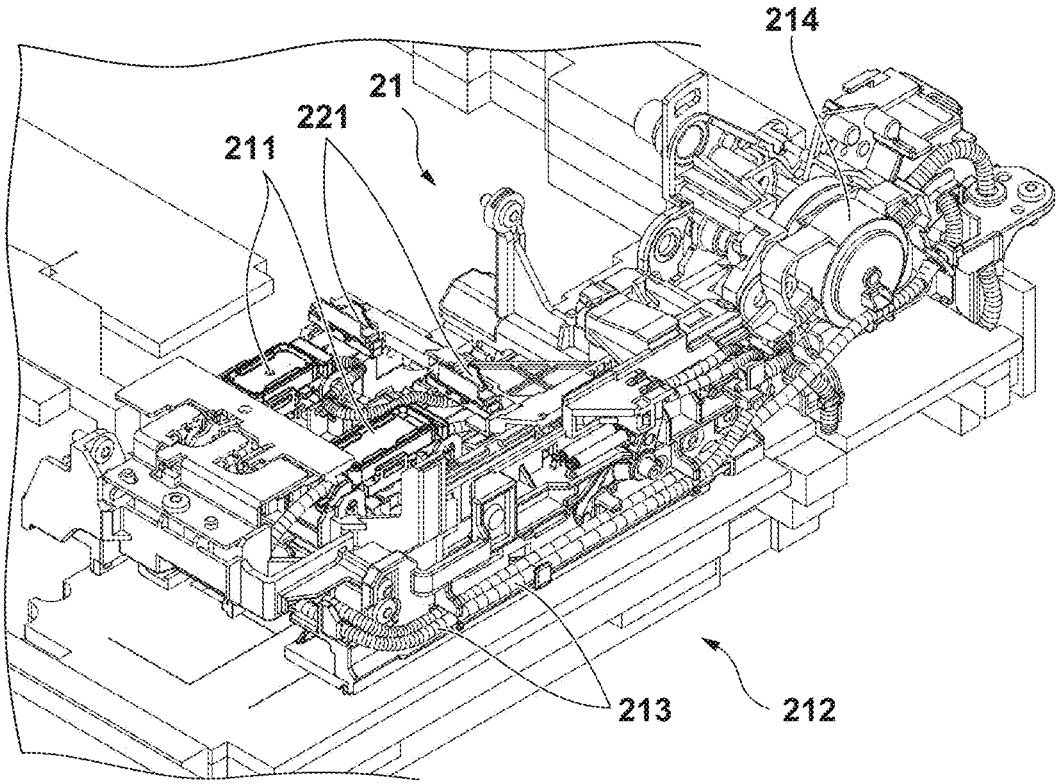
FIG. 6 is a perspective view schematically showing a recovery unit according to an embodiment.

FIG. 6 is a perspective view schematically showing a recovery unit 21. In this embodiment, the printing apparatus 1 includes the recovery unit 21 for maintaining or recovering the ejection performance (printing performance) of the printhead 14. In this embodiment, the recovery unit 21 is arranged in a main body 111 of the housing 11. The recovery unit 21 includes, the suction caps 211 that cap the printhead 14, and a suction mechanism 212 that sucks ink in the suction caps 211. The suction mechanism 212 includes suction tubes 213, each connected to a corresponding one of the suction caps 211, and a suction pump 214 that sucks ink in the suction caps 211 via the suction tubes 213. In this case, each suction tube 213 is a suction path forming member that forms an ink suction path 2131 (see FIG. 7) for sucking the ink inside the corresponding suction cap 211. Also, in this embodiment, the suction tubes 213 is formed by a flexible member such as an elastomer or the like in a manner similar to the supply tube 15.

In addition, the recovery unit 21 includes wipers 221 for wiping the ink ejection surfaces (ink ejection port surfaces) of the ink ejection ports 142, holding members (not shown) for holding the wipers 221, and ink removing members (not shown) for removing ink which adhered to the wipers 221. Note that since these components are well-known to those skilled in the art, a description will be omitted.

Figure 7:
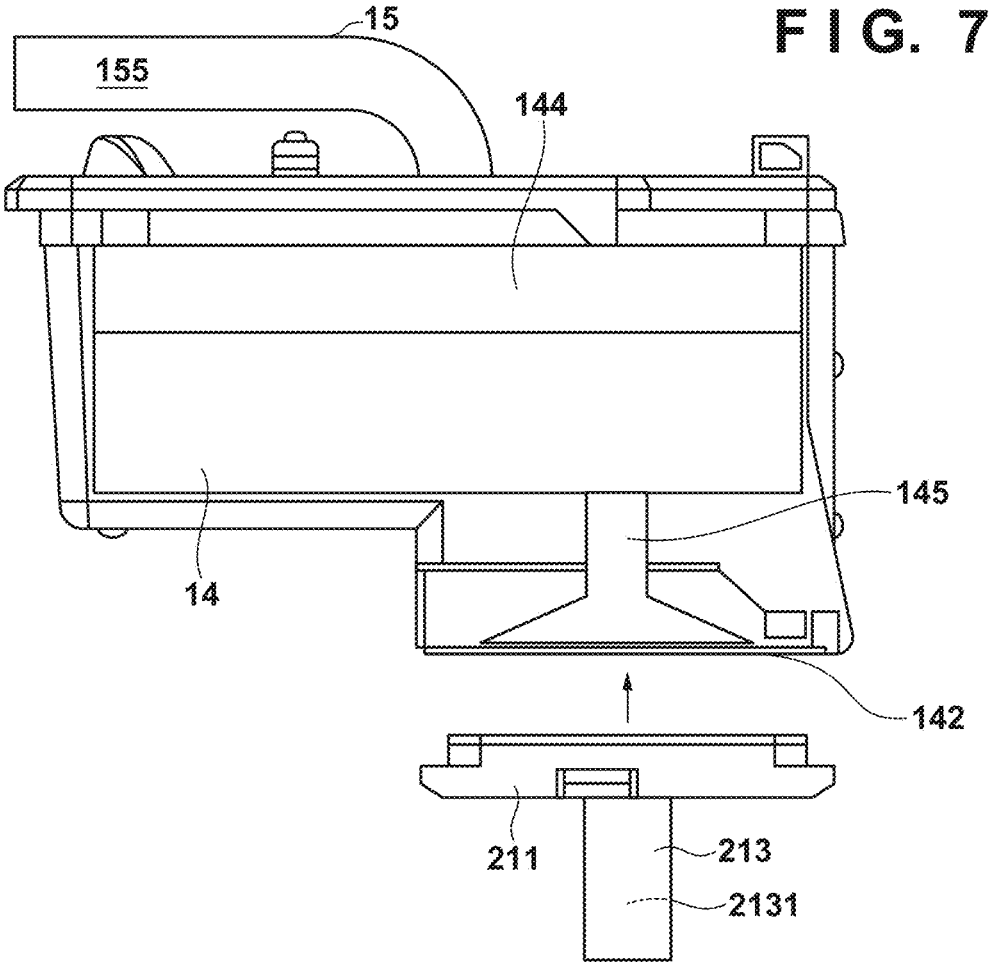
FIG. 7 is a view schematically showing the printhead and a suction cap according to an embodiment.

FIG. 7 is a view schematically showing the printhead 14 and the suction cap 211. The supply tube 15 is connected to the upper portion of the printhead 14. Also, the suction cap 211 is arranged to be able to reciprocally move to/from the ink ejection ports 142 of the printhead 14 by a cap driving unit 217 (see FIG. 9), and is able to cap, from below, the ink ejection surface on which the ink ejection ports 142 are arranged. The printhead 14 is never completely filled with ink, and an air space 144 is constantly present in the printhead. Note that each suction cap 211 is arranged at a predetermined position in the printing apparatus 1. When the recovery operation is to be performed, the carriage 13 moves the printhead 14 to the recovery position on the upper side of each suction cap 211. For example, each suction cap 211 can be arranged at a position which is within the movement region of the carriage 13 but is outside the printing region of a print medium by the printhead 14.

Figure 8:
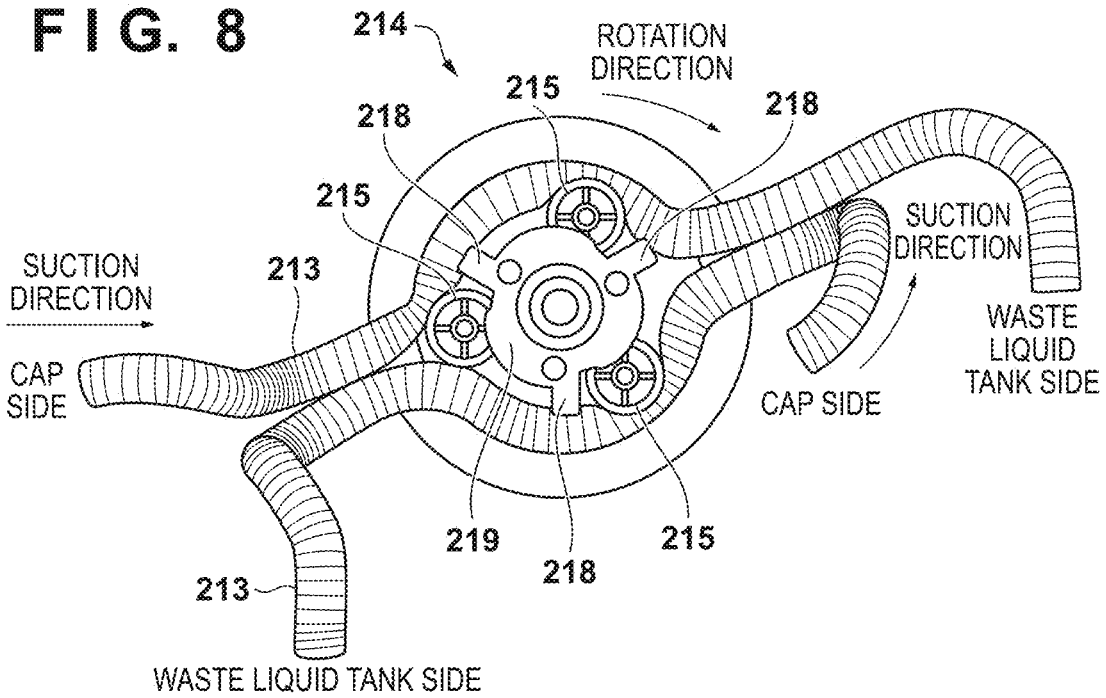
FIG. 8 is a view schematically showing a suction pump according to an embodiment.

An operation to suck ink in each suction cap 211 by the suction mechanism 212 will be described here. FIG. 8 is a sectional view schematically showing the suction pump 214. In this embodiment, the suction mechanism 212 includes two suction tubes 213, that is, a suction tube for black ink and a suction tube for color inks.

The suction pump 214 includes rollers 215, a pump driving unit 216 (see FIG. 9), a rotating member 219 that rotates in accordance with the rotation of the pump driving unit 216, and roller driving members 218 arranged so as to protrude from the rotating member 219 to the outer side of the radial direction.

The rollers 215 are arranged so as to be able to revolve about the rotation axis of the rotating member 219. When the rotating member 219 rotates, the roller driving members 218 revolve about the axis of the rotating member 219. The rollers 215 revolve about the axis of the rotating member 219 as the roller driving members 218 revolve about the rotating member 219 in a state in which the roller driving members are abutting against the rollers 215. The suction mechanism 212 performs a suction operation by causing negative pressure to be generated in the suction caps 211 by making the rollers 215 squeeze the suction tubes 213 by causing the rollers 215 to revolve around the rotating member 219 in a state in which the ink ejection ports 142 are covered by the suction caps 211.

In this embodiment, the two suction tubes 213 are vertically arranged with the rotating member 219 sandwiched between them. Also, three rollers 215 are arranged in this embodiment, and suction is simultaneously performed in the two suction tubes 213 by sequentially squeezing the suction tubes 213 by the rotation of the three rollers.

In addition, one end of each suction tube 213 is connected to a waste liquid tank (not shown), and the ink sucked by the suction pump 214 is ejected to the waste liquid tank via the suction tubes 213.

Furthermore, in this embodiment, the suction pump 214 can close each ink suction path 2131 by stopping the driving of the pump driving unit 216 in a state in which the rollers 215 are squashing the suction tubes 213. That is, in this embodiment, the suction pump 214 also acts as a closing valve of the ink suction paths 2131. Hence, since the suction pump 214 which is used for a recovery operation and is conventionally included in the printing apparatus 1 can also act as the closing valve of the ink suction paths 2131, it becomes possible reduce the number of components used in the printing apparatus 1. However, it is also possible to adopt an arrangement in which a closing valve for each ink suction path 2131 is arranged separately from the suction pump 214. In such a case, it is possible to adopt a valve having various kinds of arrangements such as a valve that can be manually operated in the manner of the manual valve 16, a valve that can be automatically opened and closed by a driving source such as a motor, and the like.

<Hardware Arrangement>

Figure 9:
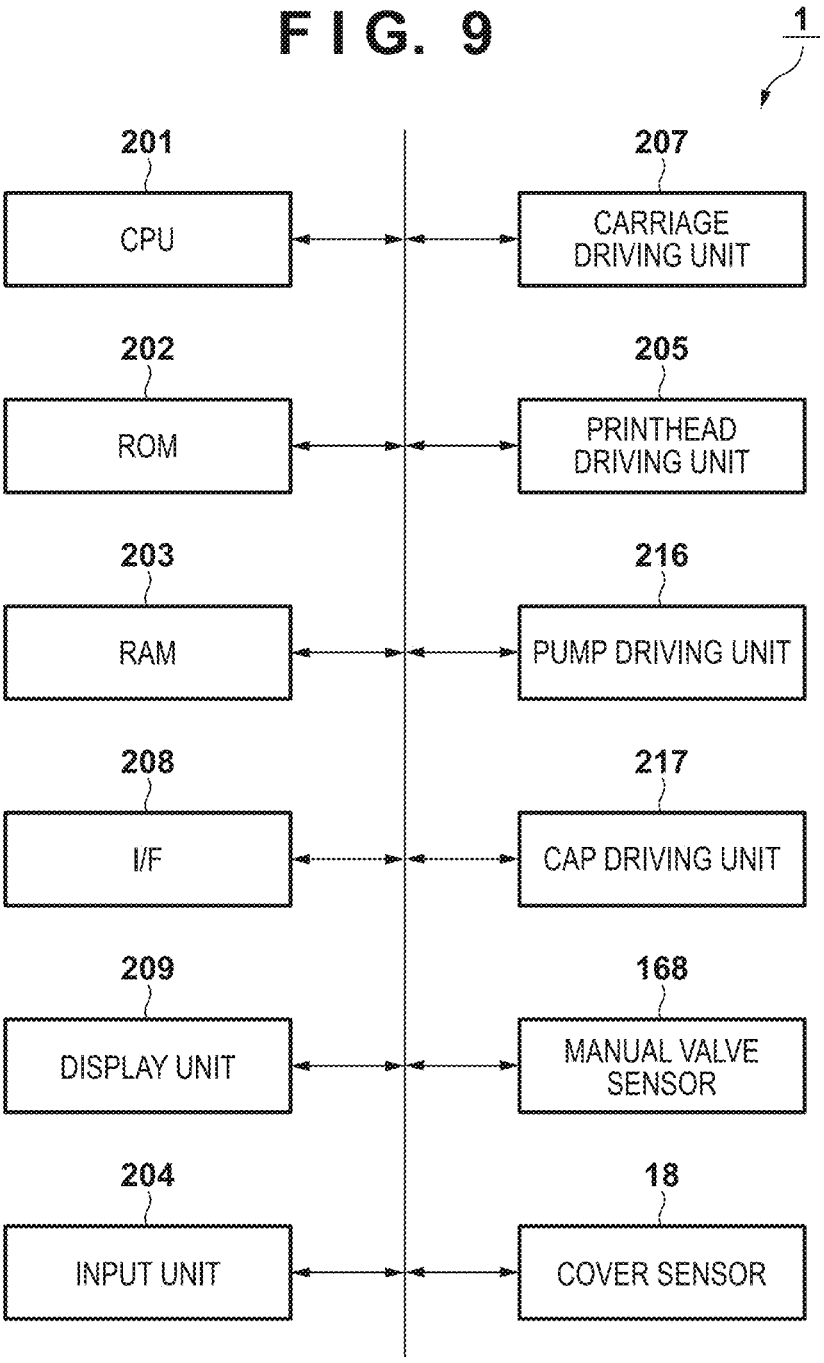
FIG. 9 is a block diagram showing an example of the hardware arrangement of the printing apparatus according to an embodiment.

FIG. 9 is a block diagram showing an example of the hardware arrangement of the printing apparatus 1. A CPU 201 integrally controls the printing apparatus 1. A ROM 202 stores control programs, various kinds of data, and the like of the CPU 201. A RAM 203 temporarily stores various kinds of data. For example, the CPU 201 executes operation control and data process of the printing apparatus 1 by reading out a program stored in the ROM 202 to the RAM 203 and executing the program. Also, in this embodiment, the CPU 201 can execute a plurality of control modes including a transportation setting mode (see FIG. 10) and a maintenance mode (see FIG. 11A).

The printhead 14 ejects ink to the print medium in accordance with the control signals transmitted from the CPU 201. A carriage driving unit 207 includes, for example, a motor, and moves the carriage 13 in accordance with the control signals transmitted from the CPU 201 via a motor driver (not shown). At this time, for example, the rotation movement of the motor is converted into a reciprocal movement by a rack and pinion mechanism (not shown) or the like. The pump driving unit 216 includes, for example, a motor, and drives the suction pump 214 in accordance with the control signal transmitted from the CPU 201 via a motor driver (not shown). The cap driving unit 217 includes, for example, a motor, and drives the suction caps 211 in accordance with the control signals transmitted from the CPU 201 via a motor driver (not shown). At this time, for example, the rotation movement of the motor is converted into a reciprocal movement by a rack and pinion mechanism (not shown) or the like. An external I/F 208 connects to a PC or the like to receive print data or the like and transmit a status signal or the like.

The CPU 201 performs recovery control of the printhead 14 by transmitting control signals to the carriage driving unit 207, the suction pump 214, and the suction caps 211. A display unit 209 displays various kinds of user interface screens such as apparatus information, a setting screen, job information, and the like. As an example, the display unit 209 is a liquid crystal display. An input unit 204 accepts inputs from the user. For example, the input unit 204 can be a touch panel or a hard key. In addition, the detection results of the cover sensor 18 and the manual valve sensor 168 are transmitted to the CPU 201. Note that FIG. 9 is a schematic view mainly showing an arrangement according to the embodiment, and the printing apparatus 1 may have another arrangement.

<Operation of Printing Apparatus>

The operation of the printing apparatus 1 according to this embodiment will be described. When the printing apparatus 1 needs to be transported between the user and a service facility or the like for repair or for maintenance, there is a possibility that the ink remaining in the printhead 14, the ink tanks 17, and the like will leak due to application of an impact during transportation or due to changes in the temperature, the pressure, or the like. Hence, an ink leakage measure can be taken during transportation.

In this case, the ink leakage measure taken when the printing apparatus 1 is to be transported from the user to a service facility can be a measure that can be taken in a simpler manner so that it will be easy for the user to understand. On the other hand, the ink leakage measure taken when the printing apparatus 1 is to be transported from the user to a service facility can be a measure that can be taken to more reliably prevent ink leakage so the ink leakage will barely occur when the printing apparatus 1 has been delivered to the user. Furthermore, the arrival of the apparatus may be simplified so that printing can be performed immediately after the printing apparatus 1 has been delivered to the user.

Thus, in the printing apparatus 1 according to this embodiment, ink leakage is suppressed more effectively by using two ink leakage measures. In this embodiment, the supply tube 15 are closed by the manual valve 16 when the printing apparatus 1 is to be transported from the user to the service facility. As a result, the ink leakage measure can be taken easily.

On the other hand, when the printing apparatus 1 is to be transported from the service facility to the user, the suction tubes 213 are closed by the suction pump 214. As a result, leakage from the printhead 14 due to changes in the temperature or pressure can be prevented. The operation processes of these measures will be described below.

Figure 10:
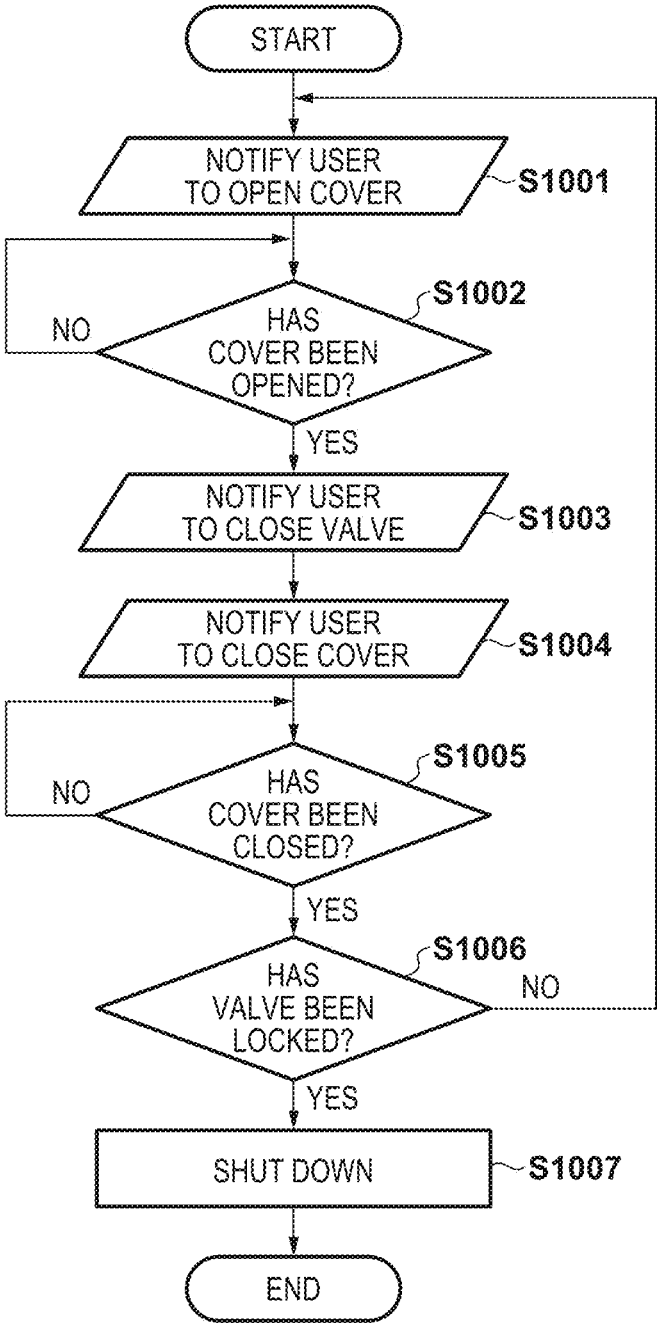
FIG. 10 is a flowchart showing an example of processing by a CPU in a transportation setting mode according to an embodiment.

FIG. 10 is a flowchart showing an example of processing performed by the CPU 201 in the transportation setting mode. The processing of this flowchart is implemented by, for example, the CPU 201 reading out a program stored in the ROM 202 to the RAM 203 and executing the program. Also, the processing of this flowchart is started, for example, when the user selects the transportation setting mode for taking an ink leakage measure when the printing apparatus 1 is to be transported from the user to the service facility.

In step S1001, the CPU 201 notifies the user to open the cover. The CPU 201 causes, for example, the display unit 209 to display a message. Note that the CPU 201 may notify the user by voice or another method, or a combination of these methods.

In step S1002, the CPU 201 confirms whether the cover member 112 has been opened. For example, the CPU 201 confirms whether the cover member 112 has been opened based on the detection result of the cover sensor 18. If the CPU 201 confirms that the cover member has been opened, the process advances to step S1003. Otherwise, the process of step S1002 is repeated. Note that the CPU 201 may confirm, based on whether the input unit 204 has accepted an operation completion input from the user, whether the cover member 112 has been opened.

In step S1003, the CPU 201 notifies the user to close the manual valve 16. The CPU 201 notifies the user by, for example, causing the display unit 209 to display a text.

In step S1004, the CPU 201 notifies the user to close the cover member 112 after the manual valve 16 has been closed. Note that the timing of this notification can be set appropriately. For example, the CPU 201 may perform the notification of step S1004 after a predetermined time has elapsed since the notification of step S1003 has been performed. Also, for example, the CPU 201 may perform the notification of step S1004 after the input unit 204 has accepted an operation completion input from the user after the notification of step S1003.

In step S1005, the CPU 201 confirms whether the cover member 112 has been closed. For example, the CPU 201 confirms, based on the detection result of the cover sensor 18, whether the cover member 112 is closed. If the CPU 201 confirms that the cover member 112 has been closed, the process advances to step S1006. Otherwise, the process of step S1005 is repeated until the cover member is closed. Note that in a case in which the cover member 112 remains open even after a predetermined time has elapsed, the CPU 201 can notify the user again to close the cover member 112 or notify the user by another warning message.

In step S1006, the CPU 201 confirms whether the manual valve 16 has been closed. For example, the CPU 201 confirms, based on the detection result of the manual valve sensor 168, whether the manual valve 16 has been closed. Note that the process of step S1006 may be performed before the notification is performed in step S1004. If the CPU 201 confirms that the manual valve 16 has been closed, the process advances to step S1007. Otherwise, the process returns to step S1001, and the user is notified again to open the cover member 112.

In step S1007, the CPU 201 performs shutdown processing, and the processing of the flowchart ends. That is, in step S1007, the CPU 201 turns off the software of the printing apparatus 1.

As described above, in the case of the transportation setting mode, the CPU 201 will perform the shutdown processing of the software after confirming that the manual valve 16 is closed. Hence, the manual valve 16 will always be in the closing state when the printing apparatus 1 is powered off in a state in which the transportation setting mode has been selected. This can prevent the user from forgetting to take the ink leakage measure when the printing apparatus is to be transported from the user to the service facility.

In this case, in a state in which the manual valve 16 is closed, there is a possibility that color mixing will occur because the ink will leak outside the printhead 14 due to the air inside the printhead 14 and the supply tubes 15 contracting/expanding as a result of pressure or temperature change. However, it is possible to reliably prevent the leakage of a large amount of ink stored in each ink tank 17, and to prevent the ink from leaking outside the apparatus. In addition, since the operation is simple, the ink leakage measure can be taken more easily by the user.

As described above, when the printing apparatus is to be transported from the user to the service facility, a simpler ink leakage measure may be taken as shown in FIG. 10. On the other hand, when the printing apparatus 1 is to be transported from the service facility to the user, a more reliable ink leakage measure needs to be taken so ink leakage will not occur when the printing apparatus is in the hands of the user. Hence, when the printing apparatus is to be transported from the service facility to the user, the ink suction paths 2131 are closed in the downstream side of the printhead 14. This processing will be described below.

Figure 11A:
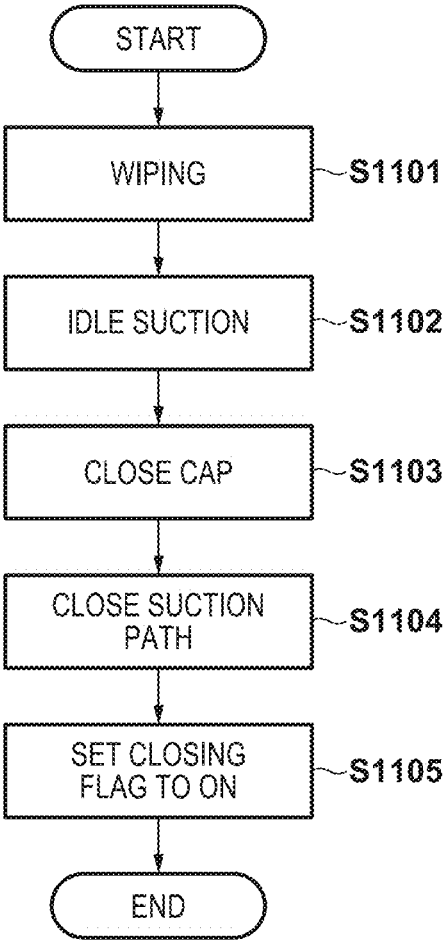
FIG. 11A is a flowchart showing an example of processing performed by the CPU when the suction pump is to close an ink suction path according to an embodiment.

FIG. 11A is a flowchart showing an example of processing performed by the CPU 201 when the suction pump 214 is to close each ink suction path 2131. The processing of this flowchart is implemented by, for example, the CPU 201 reading out a program stored in the ROM 202 to the RAM 203 and executing the program. Also, the processing of this flowchart is started, for example, when a service technician or the like activates the printing apparatus 1 in the maintenance mode to conduct repair or the like and the service technician or the like makes a power-off instruction when the repair work has ended. That is, the processing of this flowchart is executed as the shutdown processing in a case in which the printing apparatus has been activated by using the maintenance mode as the control mode.

In step S1101, the CPU 201 causes the wipers 221 to wipe the ink ejection ports 142 of the printhead 14. As a result, the ink and the like that had adhered to the ink ejection port surfaces of the respective ink ejection ports 142 are removed.

Subsequently, in step S1102, the CPU 201 drives the suction pump 214 to perform idle suction of ink from each suction cap 211. Idle suction is an operation for sucking ink from each suction cap 211 and the corresponding ink suction path 2131 without sucking ink from the printhead 14. In this embodiment, the ink inside the suction cap 211 is sucked by performing the suction operation in a state in which the suction cap 211 is spaced apart from the corresponding ink ejection port 142. As a result, the ink remaining in each suction cap 211 and each suction tube 213 can be removed.

In step S1103, the CPU 201 caps (the ejection port surface of) each ink ejection port 142 by the corresponding suction cap 211.

In step S1104, the CPU 201 drives the suction pump 214 to close each ink suction path 2131. That is, the CPU 201 restricts the movement of the rollers 215 by stopping the driving of the pump driving unit 216 in a state in which the rollers 215 of the suction pump 214 has closed the ink suction paths 2131 by squashing the corresponding suction tubes 213.

In step S1105, the CPU 201 sets a closing flag to ON and executes the shutdown processing to end the processing of this flowchart. In this embodiment, the closing flag can be regarded as information indicating that the ink suction paths 2131 have been closed. In the processing of this flowchart, the CPU 201 stores the fact that the closing flag is ON in, for example, the ROM 202.

As described above, when the printing apparatus 1 is to be transported from the service facility to the user, instead of closing the ink supply paths 155, the pump driving unit 216 of the suction pump 214 is locked in a state in which each ink ejection port 142 has been capped by the corresponding suction cap 211. As a result, the printing apparatus 1 is transported in a state in which the ink suction paths 2131 on the downstream side of the printhead 14 have been closed. Transporting the printing apparatus in this state is advantageous in that the ink leakage caused by changes in the pressure or temperature is suppressed because the ink ejection ports 142 are sealed and, thus, color mixing will hardly occur. That is, the ink channels from the printhead 14 to the suction pump 214 can be made into a closed space and will hardly be influenced by changes in the environment. Furthermore, since the manual valve 16 has not been closed, the manual valve 16 need not be opened when the printing apparatus 1 is delivered to the user. Therefore, it is possible to improve the convenience of the user.

Also, in this embodiment, although, on the one hand, the ink suction paths 2131 are closed during the shutdown processing when the maintenance mode has been selected as the control mode, the ink suction paths 2131 are not closed, on the other hand, when the transportation setting mode has been selected. In this case, the suction pump 214 is at a position, in the printing apparatus 1, which cannot be visually confirmed by the user. That is, although the manual valve 16 (the operating portion 161) is exposed when the user opens the cover member 112, the suction pump 214 is not exposed. Thus, when the user wants to close the ink suction paths 2131 to take an ink leakage measure, it is possible to consider a case in which the process cannot be performed normally due to erroneous disconnection of the power supply connection during the process or the like. However, in this embodiment, since an appropriate ink leakage measure is taken in accordance with the state, the ink leakage can be suppressed more effectively.

Figure 11B:
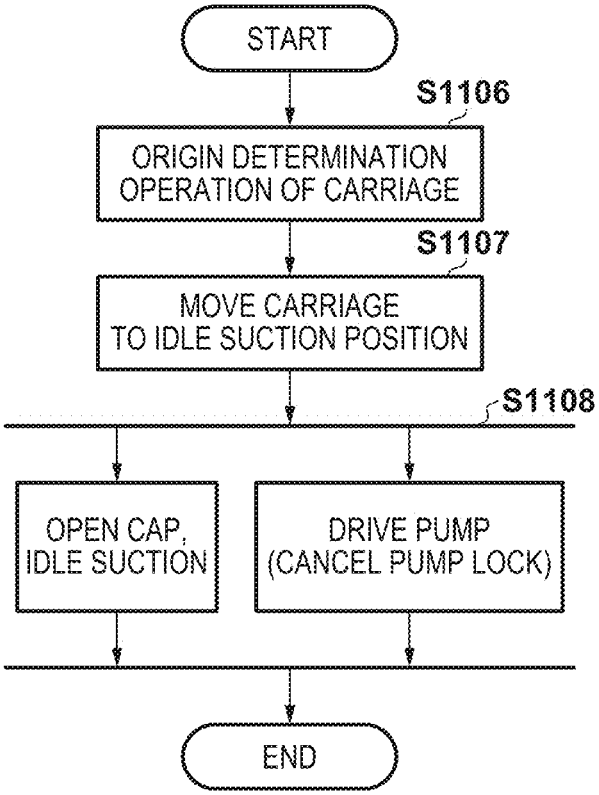
FIG. 11B is a flowchart showing an example of processing performed by the CPU when the printing apparatus is activated after the printing apparatus has been shut down in a state in which the ink suction path has been closed according to an embodiment.

FIG. 11B is a flowchart showing an example of processing performed by the CPU 201 when the printing apparatus 1 is activated after the printing apparatus had been shut down in a state in which the ink suction paths 2131 are closed. The processing of this flowchart is implemented by, for example, the CPU 201 reading out a program stored in the ROM 202 to the RAM 203 and executing the program. Also, the processing of this flowchart illustrates the operation performed when the printing apparatus 1 is transported from the service facility to the user and the user has turned on the power of the printing apparatus. That is, the operation of the printing apparatus 1 performed when the power is turned on in a state in which the closing flag is ON is shown.

In step S1106, the CPU 201 performs an origin determination operation of the carriage 13. More specifically, after the suction caps 211 are spaced apart from the ejection port surface, the carriage 13 is moved in the main scanning directions and made to abut against both ends of the scanning region to determine the origin of the encoder scale. In addition, if a lock member for suppressing the movement of the carriage 13 has been arranged at the time of transportation, this origin determination operation can notify the user to remove the lock member if he/she has forgotten to remove the lock member. Subsequently, in step S1107, the CPU 201 moves the carriage 13 to a suction position (recovery position). The suction position is a position where the printhead 14 and the suction caps 211 face each other.

In step S1108, the CPU 201 drives the pump driving unit 216 of the suction pump 214 to cancel to closing of the ink suction paths 2131 and to perform idle suction to suck ink from the suction caps 211 and the ink suction paths 2131. For example, the CPU 201 performs idle suction by the suction pump 214 in a state in which the printhead 14 and the suction caps 211 are spaced apart from each other (cap open state). However, the suction pump 214 may perform idle suction in a state in which the suction caps 211 cap the printhead 14 by making the insides of the suction caps 211 communicate with the atmosphere by an arrangement (not shown). In step S1109, the closing flag is set to OFF, and the processing ends.

In this manner, when the printing apparatus has been returned from a service facility to the user or the like, the closing of the ink suction paths 2131 is canceled, and idle suction is performed in a case in which the closing flag is ON at the time of activation (when the power is ON). That is, since the closing of the ink suction paths 2131 will be canceled in accordance with the setting of the power to ON, the user need not operate the valve. In addition, even if color mixing has occurred in the printhead 14 at the time of transportation, the ejection performance can be recovered by performing a recovery operation in accordance with the setting of the power to ON.

Figure 12:
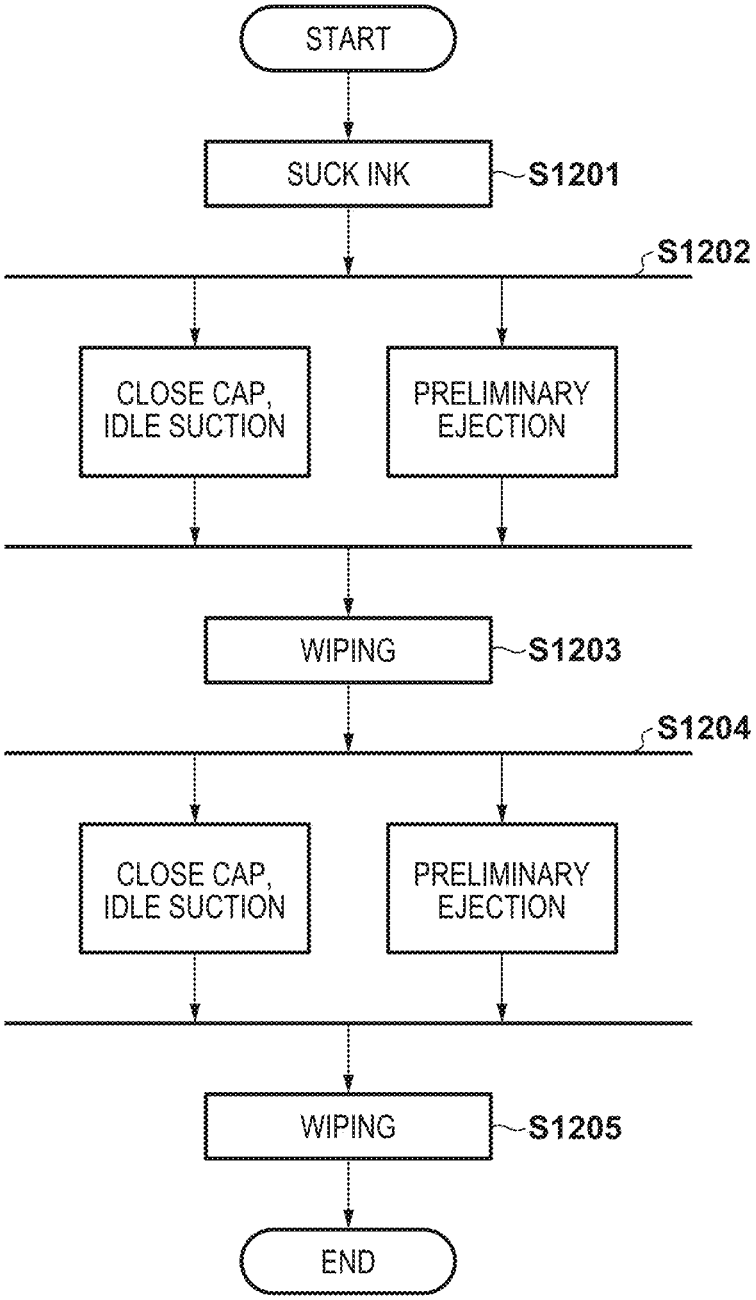
FIG. 12 is a flowchart showing an example of processing performed by the CPU in a recovery operation according to an embodiment.

FIG. 12 is a flowchart showing the processing performed by the CPU 201 in a recovery operation. This recovery operation is performed before the printing operation when a printing instruction has been received after the apparatus arrival process shown in FIG. 11B has been completed after the transportation of the printing apparatus 1. The processing of this flowchart is implemented by, for example, the CPU 201 reading out a program stored in the ROM 202 to the RAM 203 and executing the program.

In step S1201, in a state in which the ejection surface of the printhead 14 has been sealed by the suction caps 211 (capped state), the CPU 201 drives the suction pump 214 to suck, from the printhead 14, ink of the same volume as ink in an ink liquid chamber 145 which is arranged in the upper portion of each ink ejection port 142.

In step S1202, the CPU 201 performs preliminary ejection of ink and idle suction of the suction caps 211. In the preliminary ejection of ink, ink that does not contribute to printing is ejected for the maintenance of the printhead 14 to eject ink to the suction caps 211 in this embodiment. In this case, the CPU 201 can perform idle suction by the suction pump 214 by making the insides of the suction caps 211 communicate with the atmosphere by an arrangement (not shown) in a state in which the suction caps 211 cap the printhead 14 (cap closed state). As a result, the printing apparatus 1 can suppress the scattering of an ink mist generated by the preliminary ejection operation while suppressing the overflowing of ink received by the suction caps 211.

In step S1203, the CPU 201 causes wipers 221 to wipe the ejection port surface of the printhead 14. Subsequently, in step S1204, the CPU 201 performs idle suction and preliminary ejection of ink in the cap closed state again. In step S1205, the CPU 201 causes, finally, the wipers 221 to wipe the ejection port surface of the printhead 14. As a result, even if color mixing had occurred in the printhead 14 during the transportation of the printing apparatus 1, the color mixing will be sufficiently eliminated by the time of the printing operation.

Other Embodiments

In the first embodiment, only ink suction paths 2131 are closed when a printing apparatus is transported from a service facility to a user. This is because there is a possibility that closing ink supply paths 155 will make the air included in a supply system expand due to a change in the pressure or temperature, and cause ink to leak from suction caps 211. However, if the amount of air in the supply system is equal to or less than a predetermined ratio with respect to the amount of ink, both the ink supply paths 155 and the ink suction paths 2131 may be closed. As a result, there is no concern for ink leakage from the suction caps 211, and it is possible to prevent ink leakage more effectively.

Figure 13:
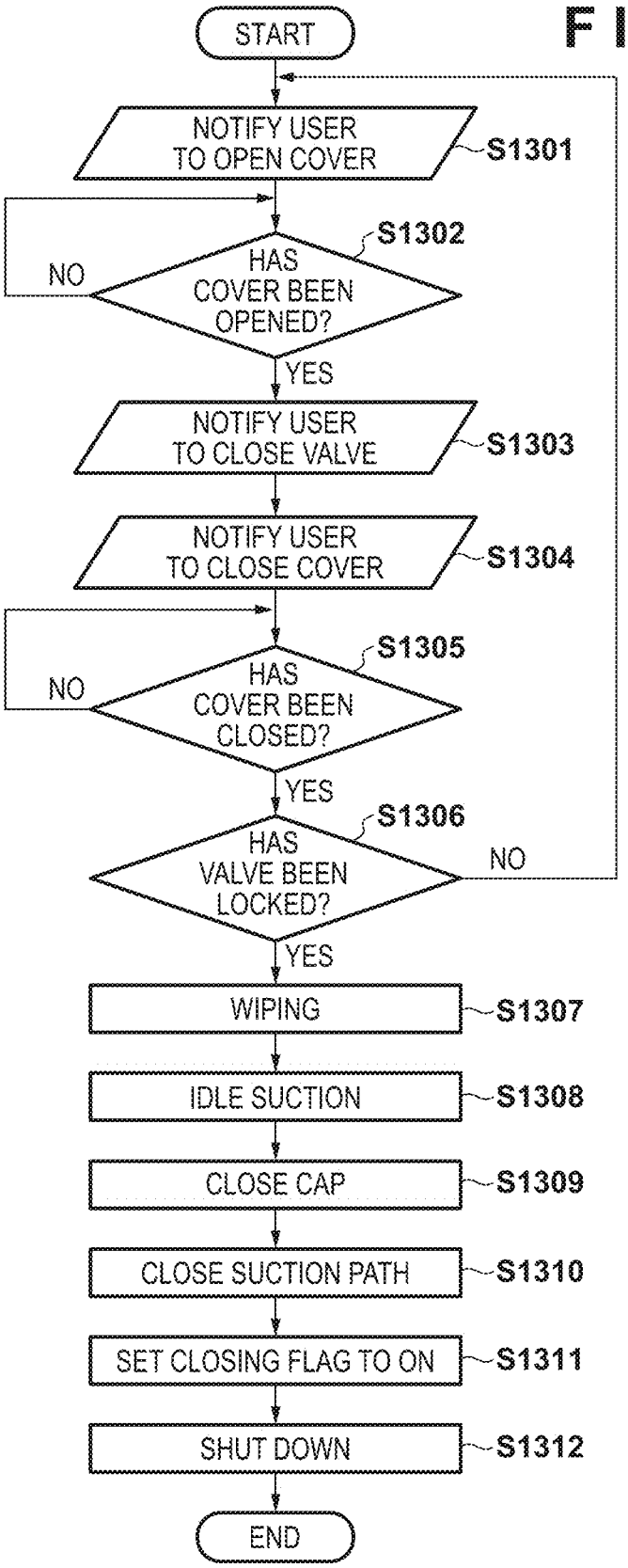
FIG. 13 is a flowchart showing processing performed by a CPU according to another embodiment.

FIG. 13 is a flowchart showing an example of processing performed by a CPU 201 of a printing apparatus 1 according to the second embodiment. The processing of this flowchart is implemented by, for example, the CPU 201 reading out a program stored in a ROM 202 to a RAM 203 and executing the program. The processes from step S1301 to step S1306 correspond to the processes from step S1001 to step S1006 of FIG. 10. In addition, the CPU 201 will not subsequently perform software shutdown processing as shown in step S1007 of FIG. 10, but will shift the process to the processing shown in FIG. 11A. The processes from step S1307 to step S1312 correspond to the processes from step S1101 to step S1105 of FIG. 11A.

According to the processing described above, both the ink supply paths 155 and the ink suction paths 2131 can be closed, and ink leakage can be prevented more effectively when the printing apparatus 1 is to be transported from the user to a service facility.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-073080, filed Apr. 5, 2019 which is hereby incorporated by reference herein in its entirety.

What is claimed is:

1. A printing apparatus that includes a cap configured to cap an ink ejection surface of a printhead configured to eject ink, an ink suction path connected to the cap and configured to suck the ink in the cap, an ink tank configured to store the ink to be supplied to the printhead, and an ink supply path configured to connect the printhead to the ink tank, comprising:

a first closing unit configured to close the ink suction path;

a second closing unit configured to close the ink supply path; and a control unit configured to be able to execute a first control mode in which the first closing unit closes the ink suction path and a second control mode in which the second closing unit closes the ink supply path.

2. The apparatus according to claim 1, wherein the ink supply path is not closed by the second closing unit in the first control mode, and the ink suction path is not closed by the first closing unit in the second control mode.

3. The apparatus according to claim 1, wherein the control unit executes the first control mode in a case in which the apparatus is to be transported from a service facility to a user, and executes the second control mode in a case in which the apparatus is to be transported from a user to a service facility.

4. The apparatus according to claim 1, wherein the first closing unit is arranged in a position which is not exposed, and the second closing unit is arranged in a position which is exposed.

5. The apparatus according to claim 4, further comprising:

a cover member arranged to open/close with respect to the apparatus, wherein the first closing unit is arranged in a position which is not exposed even in a state where the cover member is opened, and the second closing unit is arranged in a position which is exposed in a state where the cover member is opened.

6. The apparatus according to claim 1, wherein the ink suction path is formed by a tube, and the first closing unit includes a suction pump arranged on the tube.

7. The apparatus according to claim 6, wherein the suction pump includes a roller rotated by a rotating member, and the first closing unit closes the tube by the roller.

8. The apparatus according to claim 1, wherein the second closing unit includes a manual valve, which is arranged on the ink supply path and configured to be able to switch between an opening state in which the ink tank and the printhead communicate and a closing state in which the ink tank and the printhead do not communicate, and an operating portion by which the switching of the manual valve can be operated.

9. The apparatus according to claim 8, further comprising:

a first detection unit configured to detect an opening/closing state of the second closing unit, wherein in a case in which the first detection unit detects that the second closing unit is in the closing state after the second control mode has been executed, the control unit performs shutdown processing.

10. The apparatus according to claim 9, further comprising:

a notification unit configured to perform notification to prompt a user to close the ink supply path by the second closing unit.

11. The apparatus according to claim 10, further comprising:

a cover member arranged to open/close with respect to the apparatus, and a second detection unit configured to detect an opening/closing state of the cover member, wherein the control unit performs shutdown processing in a case, after the second control mode has been executed, in which the first detection unit detects that the second closing unit is in the closing state and the second detection unit detects that the cover member is closed.

12. The apparatus according to claim 1, wherein in a case in which the first control mode is to be executed, the control unit causes the first closing unit to close the ink suction path in a state in which the ink ejection surface is capped by the cap.

13. The apparatus according to claim 1, wherein a plurality of the ink tanks and a plurality of the ink supply paths are provided, and the second closing unit integrally closes the plurality of the ink supply paths.

14. The apparatus according to claim 1, wherein a plurality of the ink tanks and a plurality of the ink supply paths are provided, and the second closing unit individually closes each of the plurality of the ink supply paths.

15. The apparatus according to claim 1, wherein in a case in which power of the apparatus is set to ON after the first control mode has been executed, the control unit cancels the closing of the ink supply path by the first closing unit.

16. The apparatus according to claim 1, further comprising:

a reciprocally movable carriage configured to carry the printhead, wherein the cap is arranged outside a printing region of the printhead.

17. The apparatus according to claim 1, wherein the ink tank includes an injection port to which ink is injected.

18. A control method of a printing apparatus that includes, a cap configured to cap an ink ejection surface of a printhead configured to eject ink, an ink suction path connected to the cap and configured to suck ink in the cap, an ink tank configured to store the ink to be supplied to the printhead, and an ink supply path configured to connect the printhead to the ink tank, the method comprising:

performing a first closing process in which the ink suction path is closed;

performing a second closing process in which the ink supply path is closed; and performing a control process in which a first control mode in which the ink suction path is closed by the first closing process and a second control mode in which the ink supply path is closed by the second closing process can be executed.

19. A transportation method of a printing apparatus that includes, a cap configured to cap an ink ejection surface of a printhead configured to eject ink, an ink suction path connected to the cap and configured to suck ink in the cap, an ink tank configured to store the ink to be supplied to the printhead, and an ink supply path configured to connect the printhead to the ink tank, the method comprising:

performing a first closing process in which the ink suction path is closed;

performing a second closing process in which the ink supply path is closed;

performing a control process in which a first control mode in which the first closing process is performed to close the ink suction path and a second control mode in which the second closing process is performed to close the ink supply path can be executed;

performing a first transportation process of transporting the printing apparatus upon closing the ink suction path by the first control mode; and performing a second transportation process of transporting the printing apparatus upon closing the ink supply path by the second control mode.

* * * * *